US005394939A

United States Patent [19]

Walker

[11] Patent Number: 5,394,939

[45] Date of Patent: Mar. 7, 1995

[54] WELL HEAD STUFFING BOX LEAK DETECTOR AND CONTAINER

[76] Inventor: Robert L. Walker, 1425 E. Fourth St., Odessa, Tex. 79761

[21] Appl. No.: 93,749

[22] Filed: Jul. 20, 1993

[51] Int. Cl.[6] ..... E21B 33/08

[52] U.S. Cl. ..... 166/81; 166/84; 166/93

[58] Field of Search ..... 166/81, 84, 82, 93, 166/97

[56] References Cited

U.S. PATENT DOCUMENTS

| | | | |
|---|---|---|---|
| 3,209,830 | 10/1965 | Orr et al. . | |
| 3,276,246 | 10/1966 | Truman et al. . | |
| 4,665,976 | 5/1987 | Retherford | 166/93 X |
| 4,872,508 | 10/1989 | Gordon | 166/84 |
| 4,917,190 | 4/1990 | Coppedge . | 166/84 |
| 4,951,743 | 8/1990 | Henderson | 166/84 |
| 5,067,563 | 11/1991 | Rode | 166/84 |
| 5,148,699 | 9/1992 | Morse | 166/84 |
| 5,150,751 | 9/1992 | Burton et al. | 166/93 X |
| 5,211,227 | 5/1993 | Anderson | 166/84 |
| 5,246,067 | 9/1993 | Heinonen et al. | 166/81 |

*Primary Examiner*—Terry Lee Melius
*Attorney, Agent, or Firm*—Richard C. Litman

[57] ABSTRACT

A well head stuffing box leak detector and container is installable about the stuffing box of an oil well pump installation and provides for containment of any fluid leakage from worn packing or seals within the stuffing box. The device is relatively inexpensive to construct, being formed essentially of sheet and angle material. The lower seal or gasket is raised above the floor of the device, in order to prevent fluid saturation and outflow from the lower seal, and a non-concentric offset sump is also provided. The sump includes an explosion proof float assembly and switch which may be set at a predetermined position to activate an alarm and/or shut off the pump, if excessive fluid escapes from the stuffing box and collects in the sump. The device is formed in two semicylindrical halves which are hingedly connected, thus providing for easy installation about the well head T beneath the stuffing box and the polish rod extending from the top of the stuffing box.

11 Claims, 2 Drawing Sheets

WELL HEAD STUFFING BOX LEAK DETECTOR AND CONTAINER

FIELD OF THE INVENTION

The present invention relates generally to devices providing for the containment of overflow from a fluid source, such as sumps and the like, and more specifically to a low pressure container constructed of sheet and angle material and specifically formed to fit around the stuffing or packing box of an oil well head. The container serves to catch any fluid which may escape along the reciprocating polish rod as it exits the stuffing box, and further serves to shut down the pump if excessive fluid escapes the stuffing box seal.

BACKGROUND OF THE INVENTION

Oil wells generally comprise a positive pressure pump located beneath the surface within the oil source, which pump is mechanically operated from the surface by a rod string operated by a walking beam apparatus. The top of the rod string passes into the well casing at the surface well head through a "stuffing (or packing) box", and the upper portion of the rod string is enclosed in a "polish (or polished) rod" which provides a smooth surface to wear against the seal(s) in the stuffing box.

Normally, several such pumps are in continuous operation at remote sites, monitored only at a central location by a human observer. Moreover, the harsh environment at the well head (corrosive chemicals, sand and abrasives, etc.) can cause the packing or seals in the stuffing box to deteriorate rapidly, thereby allowing oil to gather on the polish rod and be drawn upward past the worn seals and be thrown about the immediate environment due to the reciprocating action of the rod. The Environmental Protection Agency has developed strict regulations against such occurrences, and consequently oil well owners have almost universally equipped wells with various devices to prevent the escape of oil residue from worn stuffing box seals.

However, the various devices developed thus far are relatively complex assemblies of specially machined, cast or forged components, and are generally constructed to withstand relatively high pressures. Such devices are excessively costly and redundant in view of the stuffing box which is already located at the well head.

What is needed is a simple, low pressure means of containment of any oil spillage or residue resulting from worn seals or packing at the stuffing box of an oil well head. The device must be capable of being quickly and easily installed about the stuffing boxes of most existing well heads, and must further serve to collect and contain a reasonable volume of spillage to preclude its escape to the surrounding environs. Moreover, the device must provide a warning and/or shut down the pump in the event of fluid accumulation beyond a predetermined level.

DESCRIPTION OF THE PRIOR ART

U.S. Pat. No. 3,209,830 issued to Gerald H. Orr et al. on Oct. 5, 1965 discloses a Stuffing Box Assembly formed of a relatively complex assembly of machined pipe-like fittings and components. Rather than providing a container for fluid leakage, a reservoir containing lubricating fluid for the polish rod is provided. At the time of this patent, environmental concerns were not so prevalent, as evidenced by the statement that "the loss of small amounts of lubricating fluid through the stuffing box 22 is not a matter of serious concern" in column 6, lines 26 through 28 of the patent.

U.S. Pat. No. 3,276,246 issued to Paul W. Truman on Oct. 4, 1966 discloses a Stuffing Box With Leakage Detector. The device includes a lateral reservoir for the containment of leakage, but also includes an opposite lubrication reservoir in the event no oil is flowing from the well. The device is not actually a stuffing or packing box, but rather rests atop the existing well head stuffing box, unlike the present invention which is disposed about the stuffing box.

U. S. Pat. No. 4,872,508 issued to Richard W. Gordon on Oct. 10, 1989 discloses an Oil Well Pump Leakage Accumulator which rests atop the stuffing box as in the Truman device discussed above, rather than being installed to surround the stuffing box as in the present invention.

U. S. Pat. No. 4,917,190 issued to Dennis R. Coppedge on Apr. 17, 1990 discloses an Oil Well Blowout Containment System which device also rests atop the stuffing box, as in the case of the Truman and Gordon devices discussed above. Additional differences are noted, such as the provision for lubricating fluid by the Coppedge device and the lack of a separate containment sump.

U.S. Pat. No. 4,951,743 issued to Tom Henderson on Aug. 28, 1990 discloses an Environmental Leakage Protector For Reciprocating Rod Fluid Displacement Arrangements. The device primarily comprises an axially extendible bellows which is placed about the polish rod above the stuffing box.

U. S. Pat. No. 5,067,563 issued to Walter H. Rode on Nov. 26, 1991 discloses a Spillproof Oil Well Seal which provides, among other features, for the return of bypassed liquid and gas to the well production line. The resulting device essentially comprises a stuffing box and containment means, and is accordingly relatively complex with a series of valves and seals not required for the present invention, which is intended to capture excess fluid bypass rather than returning it to a fluid flow line.

U. S. Pat. No. 5,148,699 issued to Robert L. Morse on Sep. 22, 1992 discloses a Stuffing Box Leak Detector formed of relatively heavy fittings and installed between the stuffing box and the stuffing box cover. A separate reservoir is connected thereto. Accordingly, the stuffing box must be disassembled for the installation or removal of the Morse device, unlike the present invention.

Finally, U. S. Pat. No. 5,211,277 issued to L. F. Anderson on May 18, 1993 discloses a Fugitive Emissions Accumulator comprising two flanged and generally semicylindrical halves which are installable about the polish rod above the stuffing box. A drain line is provided to a separate container. As in the case of the other similarly installed devices, the installation immediately above the stuffing box does little to contain spillage should fluid gather in the device and the bottom seal of the device leak. The present invention, with its raised bottom seal and offset sump, serves to prevent most of the fluid from leaking from the container even in the event of the lower seal leaking.

None of the above noted patents, taken either singly or in combination, are seen to disclose the specific arrangement of concepts disclosed by the present invention.

SUMMARY OF THE INVENTION

By the present invention, an improved well head stuffing box leak detector and container is disclosed.

Accordingly, one of the objects of the present invention is to provide an improved well head leak detector and container which installs about the well head stuffing box to provide complete containment for the stuffing box.

Another of the objects of the present invention is to provide an improved well head leak detector and container which is essentially formed of sheet and angle structural material.

Yet another of the objects of the present invention is to provide an improved well head leak detector and container which provides a raised concentric lower seal, in order to raise the level of the seal above the level of the surrounding container bottom and any fluid accumulated thereon.

Still another of the objects of the present invention is to provide an improved well head leak detector and container which includes an offset lower sump for the containment of fluid leakage from the stuffing box, with quick drain means in the sump for the drainage of accumulated fluid therefrom.

A further object of the present invention is to provide an improved well head leak detector and container which includes fluid level detection means within the sump, thereby to provide warning and/or pump shutoff means when the fluid level within the sump reaches a predetermined level.

A final object of the present invention is to provide an improved well head leak detector and container for the purposes described which is inexpensive, dependable and fully effective in accomplishing its intended purpose.

With these and other objects in view which will more readily appear as the nature of the invention is better understood the invention consists in the novel combination and arrangement of parts hereinafter more fully described, illustrated and claimed with reference being mad to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
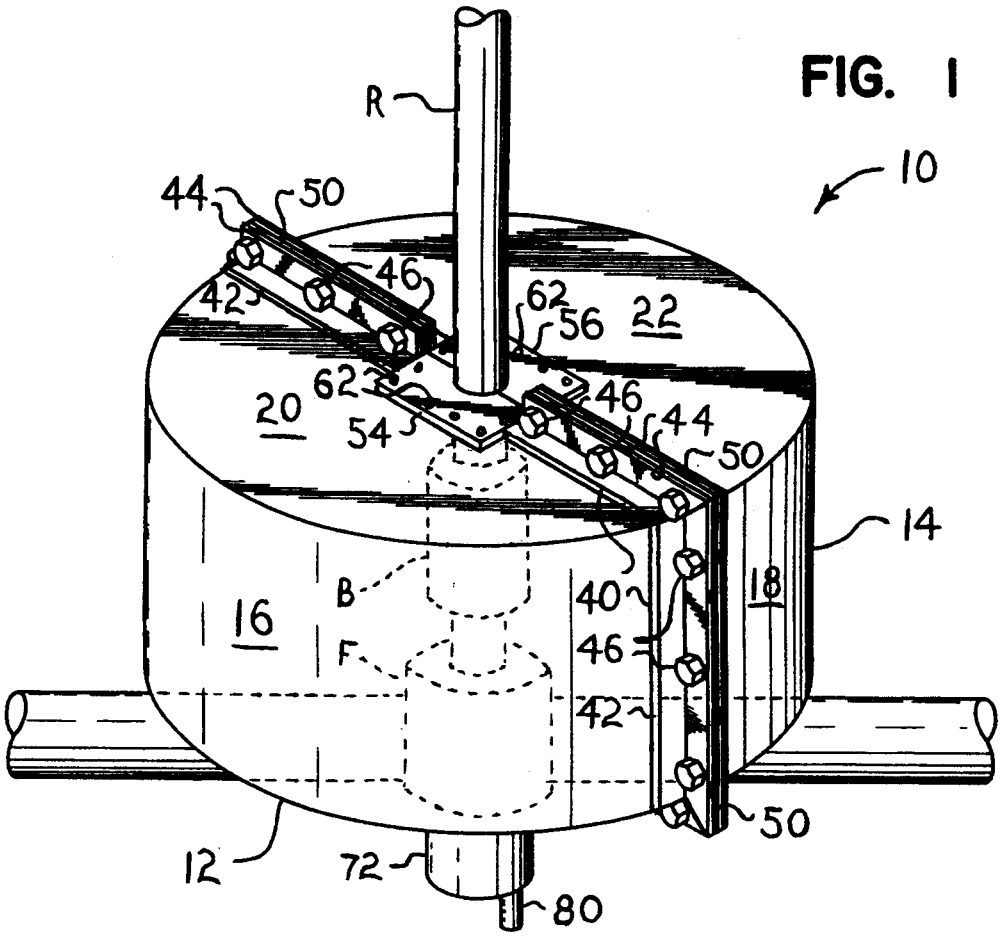
FIG. 1 is a perspective view of the well head leak detector and container of the present invention, showing its installation at a well head T and stuffing box.

Referring now particularly to FIG. 1 of the drawings, the present invention will be seen to relate to a well head stuffing box leak container and detector 10 installed at an oil well T assembly and enclosing a stuffing box B therewithin. Leak container/detector 10 is preferably constructed in the General form of a relatively wide diameter, short cylinder, in two generally semicylindrical halves 12 and 14. The first and second sides 16 and 18 respectively of the first and second halves 12 and 14, as well as the first and second top surfaces 20 and 22 and the first and second bottom surfaces 24 and 26 (shown in FIG. 2), are all preferably formed of sheet metal material for lightness and economy of construction. It has been found that galvanized steel sheet material, particularly using the G-90 galvanizing process, provides particularly good service in the well head environment, yet is relatively economical.

Figure 2:
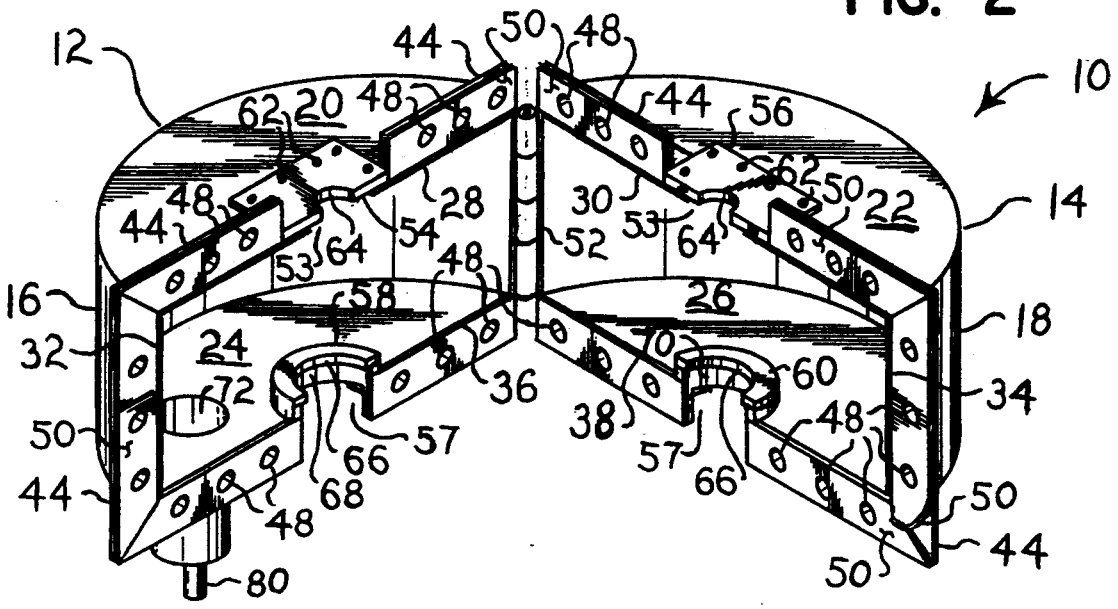
FIG. 2 is a perspective view of the opened leak detector and container, showing its two semicylindrical halves and structural details thereof.

The mating first and second upper edges 28 and 30, first and second side edges 32 and 34, and first and second lower edges 36 and 38 each include means providing for the assembly of the first and second halves 12 and 14 together, such as the stock angle material or angle iron 40 shown; FIG. 2 discloses the mating edges 28 through 38 discussed above. The first flange 42 of the angle material 40 is permanently secured (e.g., welding, with the galvanized coating of the sheet material restored after welding) to the respective edges 28 through 38 of the appropriate half 12 or 14 of the device 10, while the second flanges 44 extend outward from the respective sides of the detector/container 10. These second flanges 44 will be seen to be parallel to one another and mating when the two halves 12 and 13 of the detector/container 10 are closed, and may be secured together by means of bolts 46 or other suitable fasteners and cooperating flange holes 48 (FIG. 2). In order to preclude leakage between the mating second flanges 44, a seal or gasket 50 (e.g., a synthetic elastomer material such as neoprene) is adhesively attached to the mating faces of the second flanges 44.

As described above, Only the upper edges 28 and 30, lower or bottom edges 36 and 38, and mating edges 32 and 34 of one side are provided with angle material 40. The remaining second side is equipped with a hinge 52, serving to connect the two halves 12 and 14 together. Hinge 52 is shown in FIG. 2, showing the two halves 12 and 14 of the detector/container 10 in their opened state.

Both the upper portions 20 and 22 and the lower portions 24 and 26 will be seen to include openings or discontinuities 53 and 57 in their respective surfaces, which provide for closure of the detector/container 10 about an included structure extending upwards and downwards therefrom. The respective angles 40 along the upper edges 28 and 30 and lower edges 36 and 38 are also discontinuous along the center of the respective edges for the same reason.

Further sealing of the detector/container 10 is provided by central mating first and second upper seal halves 54 and 56, and mating first and second lower seal halves 58 and 60 (FIG. 2). These seals 54 through 60 are preferably formed of a relatively soft and pliable material, such as felt, although other materials may be used as desired or required. These seal components 54 through 60 are secured to the respective surrounding structure (e.g., to the first and second upper surfaces 20 and 22 of the detector/container 10, in the case of the upper seal halves 54 and 56) adjacent the respective upper and lower discontinuities or openings 53 and 57, by appropriate means, such as rivets 62, screws, adhesives, etc., as desired. Each of the upper seal halves 54 and 56 includes a semicircular cutout 64, which is formed to bear against a reciprocating polish rod R or other structure extending through the cutout 64 when the detector/container is closed about a stuffing box B. The lower seal halves 58 and 60 each include similar cutouts 66, which are formed to fit closely against the underlying well head T structure immediately beneath the stuffing box B.

The lower seal halves 58 and 60 will be seen to be raised above the bottom surfaces 24 and 26 of the detector/container 10, by means of two mating, semicircular collar halves 68 and 70. The lower edges of these collar halves 68 and 70 are welded or otherwise secured to the respective edges of the openings 57 in the two bottom portions 24 and 26 of detector/container 10, with the lower seal halves 58 and 60 being secured to upper edges of the collar halves 68 and 70. This structure serves to raise the relatively porous seal material of the seal halves 58 and 60, above the lower surface portions 24 and 26 of the detector/container 10. Thus, in the event that the lower surfaces 24 and 26 became flooded with oil, such oil would be unable to escape through the lower passage 57 due to the raised edges of the collar halves 68 and 70. Moreover, this structure results in an inset defined by the lower central opening 57, the collar halves 68 and 70, and the two lower seal halves 58 and 60, when the two halves 12 and 14 of the detector/container 10 are secured together. This lower inset provides some seating of the leak detector/container upon a lower structure, such as the well head T pipes and fittings F immediately below the stuffing box B.

Figure 3:
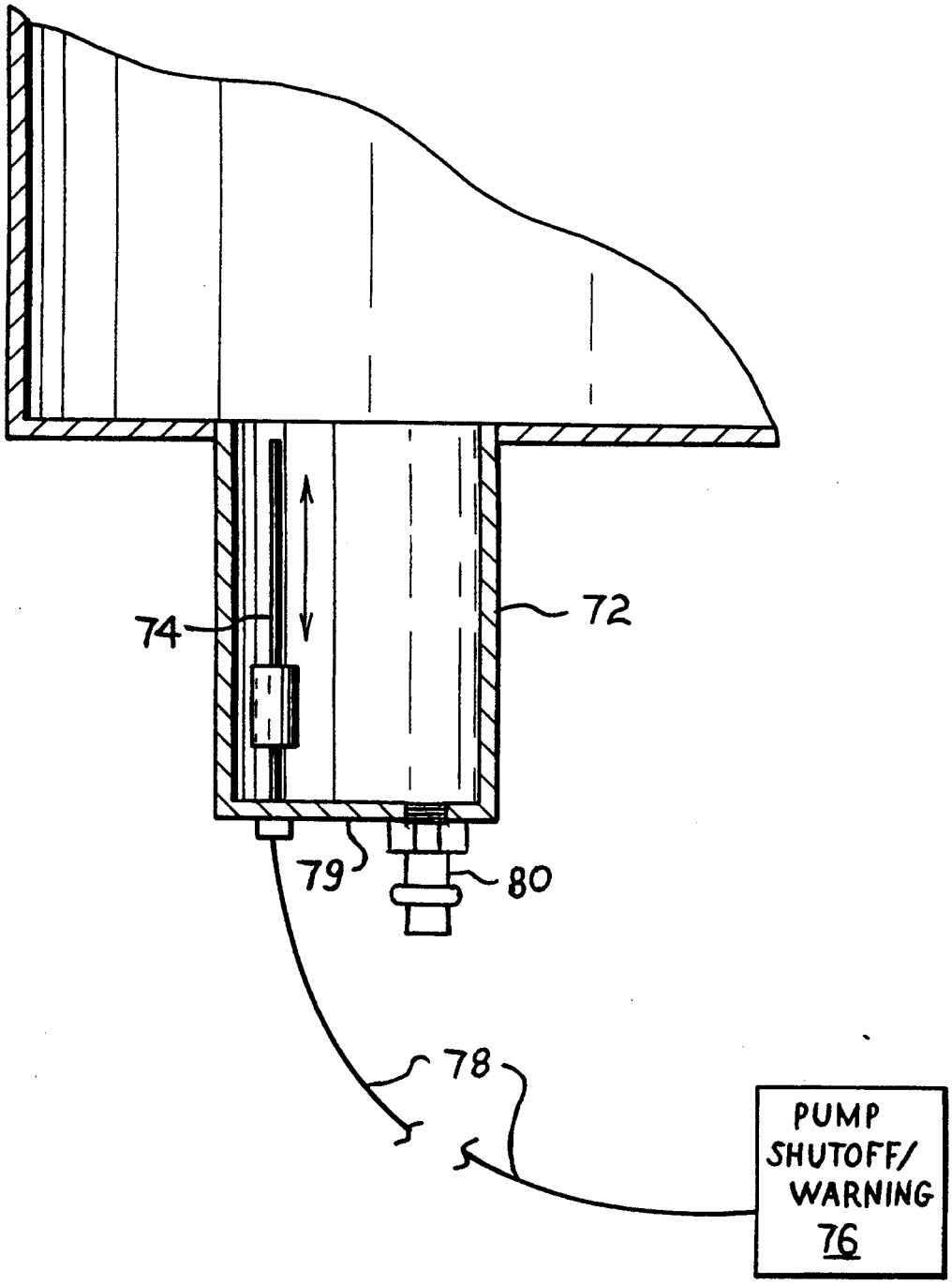
FIG. 3 is a broken away side view of the sump portion of the leak detector and container of the present invention, showing its details.

The above described structure serves to contain leakage emitted from leaking seals at the upper end of the stuffing box B, as the polish rod R exits the box B. However, some means is required to alert personnel in the event of excessive leakage, and to provide for additional containment volume and for drainage of oil bypassed from a leaking stuffing box B. The present invention provides for such by means of a radially offset sump 72 installed in the bottom of the detector/container 10, more clearly shown in FIG. 3 of the drawings. The sump 72 extends below the lower surface 24 and 26 of the remainder of the detector/container 10, and serves to collect oil residue at a low point in the system. A sump quantity transducer 44 is installed within the sump 72, which transducer serves to provide a signal to a remote monitoring site in the event the oil quantity within the sump reaches a predetermined volume. Preferably, the quantity transducer 74 is an explosion proof type requiring very little electrical voltage and amperage, in order to reduce the potential danger of oil vapor ignition and explosion. Capacitance type devices are particularly suitable for this purpose and a number of such are available, e.g., the Stahl float relay has been found to be practicable in combination with the present invention.

The quantity transducer is connected to a remote pump shutoff and/or warning device 76 such as a relay to close a circuit to actuate a warning light or aural warning, and/or open a circuit to disable the prime mover for the associated pump, by means of wiring 78. When the operator or monitoring person is thus alerted that the oil collected in the sump 72 has reached a level sufficient to shut down the pump and/or alert the operator/monitoring person, the collected oil may be drained by means of a drain valve in the bottom 79 of the sump, such as the quick drain 80 shown, in order to permit operation of the pump and/or disable the alarm.

The oil well head stuffing box leak detector and container 10 described above is installed about a well head stuffing box S by closing and securing the opened detector/container 10 about the stuffing box S at the well head, with the stuffing box S completely enclosed within the detector/container 10 and the central bottom inset immediately below the lower seal portions 58 and 60 resting upon any well head fittings F immediately therebelow. The polish rod R extending from the stuffing box B, passes through the upper surface opening 53 and bears against the upper seal components 54 and 56. In the typical well head, the vast majority of any leakage which occurs is due to worn or damaged seals in the stuffing box, thereby allowing oil to escape along the sides of the polish rod as it reciprocates in the well head. The present invention provides a wiping action to remove such low pressure oil leakage from the polish rod by means of the upper seals 54 and 56, which oil then collects in the interior of the detector/collector 10. The raised lower seals 58 and 60 and collar portions 68 and 70 preclude the escape of collected oil from the lower opening 57, whereupon the collected oil flows to the lowest point in the detector/collector 10, i.e., the sump 72. A sufficient quantity of oil collected in the sump 72 will activate the pump shutoff/warning means 76 described above, thereby alerting personnel to drain the collected oil. In the event that the shutoff/warning means 76 is activated frequently, thus indicating relatively large amounts of oil leakage from the stuffing box, the detector/container 10 may be easily opened and the packing of the stuffing box repaired or replaced as required, and the detector/container 10 replaced about the stuffing box for further protection of the environment. The present invention serves to prevent the loss of escaped oil under relatively low pressure to the immediate environment, thus satisfying environmental regulations relating to such losses in oil production.

It is to be understood that the present invention is not limited to the sole embodiment described above, but encompasses any and all embodiments within the scope of the following claims.

I claim:

1. An oil leakage detector and container for use in the detection and containment of low pressure oil leaks from the polish rod seal of an oil well pump head stuffing box having connection to an oil well head T, said oil leakage detector and container comprising:

a hollow, cylindrical container having a top surface, a bottom surface, and a cylindrical side surface formed of sheet material and divided into a first and a second semicylindrical portion;

said first and said second semicylindrical portion each having an upper edge, a lower edge, and first and second side edges, with each corresponding said upper edge, said lower edge, and said first and second side edges mating with one another to provided closure means for said oil leakage detector and container;

said oil leakage detector and container further including a central upper opening and a central lower opening each having gasket means disposed therearound, with said central upper opening, said central lower opening, and said gasket means each divided in half, with each said half of said central upper opening, said central lower opening, and said gasket means respectively residing in said first and said second semicylindrical portion;

said central lower opening including a first and a second lower collar half respectively extending upward from said bottom surface of said first and second semicylindrical half and each having a respective upper edge, with each said upper edge having said lower opening gasket means secured thereto, whereby;

said first and said second lower collar half and said lower opening gasket means define an inset within said bottom surface with said inset providing for the seating of said oil leakage detector and container upon a well head fitting, and said lower opening gasket means is raised above said bottom surface to preclude saturation by oil collected within said oil leakage detector and container;

said bottom surface including a sump asymmetrically disposed therein and extending therebelow;

said sump including fluid level detection means disposed therein with said fluid level detection means communicating with a remote sump oil quantity signal means, and a sump bottom with drain means disposed in said sump bottom, whereby;

said oil leakage detector and container is closed by means of said first semicylindrical portion and said second semicylindrical portion when installed at an oil well head T to enclose a well head stuffing box within said oil leakage detector and container, with said gasket means of said lower opening closely fitting about the connection between the stuffing box and the well head T and said gasket means of said upper opening closely fitting about the polish rod extending from the stuffing box, thereby collecting oil escaping from the stuffing box along the polish rod within said oil leakage detector and container with the oil collecting in said sump, and said fluid level detection means activating said remote sump oil quantity signal means to provide a signal when the sump oil quantity has reached a predetermined level.

2. The oil leakage detector and container of claim 1 wherein:

said first and said second semicylindrical portion are secured together along said first side edges by hinge means.

3. The oil leakage detector and container of claim 1 wherein:

said sheet material comprises galvanized sheet metal.

4. The oil leakage detector and container of claim 3 wherein:

said sheet metal is galvanized by means of the G-90 galvanizing process.

5. The oil leakage detector and container of claim 1 wherein:

said gasket means of said central upper opening and said central lower opening are each formed of felt material.

6. The oil leakage detector and container of claim 1 wherein:

said closure means comprises a plurality of lengths of angle stock material each having a first and a second flange extending therefrom, with each said first flange secured to each said upper edge, said lower edge, and said second side edge of said first and said second semicylindrical portion, and each said second flange extends outward from each said upper edge, said lower edge, and said second side edge of said first and said second semicylindrical portion, with each said second flange of said first semicylindrical portion being parallel to and mating with a corresponding each said second flange of said second semicylindrical portion when said first semicylindrical portion and said second semicylindrical portion are placed together, whereby;

each said second flange of said first semicylindrical portion is secured to each said corresponding second flange of said second semicylindrical portion thereby to provide for the secure closure of said oil leakage detector and container about an oil well head stuffing box.

7. The oil leakage detector and container of claim 6 including:

sealing means disposed between each said second flange of said first semicylindrical portion and each said corresponding second flange of said second semicylindrical portion.

8. The oil leakage detector and container of claim 1 wherein:

said fluid level detection means comprises an explosive proof fluid quantity transducer.

9. The oil leakage detector and container of claim 1 wherein:

said sump drain means comprises a quick drain.

10. The oil leakage detector and container of claim 1 wherein:

said remote sump oil quantity signal means comprises an alarm, whereby notification to monitoring personnel is provided when the oil quantity in said sump reaches a predetermined level.

11. The oil leakage detector and container of claim 1 wherein:

said remote sump oil quantity signal means comprises a pump shutoff, whereby the well pump is deactivated when the oil quantity in said sump reaches a predetermined level.

* * * * *